US010401068B2

(12) United States Patent
Kopko et al.

(10) Patent No.: US 10,401,068 B2
(45) Date of Patent: Sep. 3, 2019

(54) AIR COOLED CHILLER WITH HEAT RECOVERY

(71) Applicant: Johnson Controls Technology Company, Holland, PA (US)

(72) Inventors: William L. Kopko, Jacobus, PA (US); Satheesh Kulankara, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 1015 days.

(21) Appl. No.: 14/655,583

(22) PCT Filed: Jan. 14, 2014

(86) PCT No.: PCT/US2014/011510

§ 371 (c)(1),
(2) Date: Jun. 25, 2015

(87) PCT Pub. No.: WO2014/113397

PCT Pub. Date: Jul. 24, 2014

(65) Prior Publication Data

US 2015/0345846 A1 Dec. 3, 2015

Related U.S. Application Data

(60) Provisional application No. 61/752,821, filed on Jan. 15, 2013.

(51) Int. Cl.

| | |
|---|---|
| ***F25B 49/02*** | (2006.01) |
| ***F25B 13/00*** | (2006.01) |
| ***F25B 40/04*** | (2006.01) |

(52) U.S. Cl.

CPC ..... *F25B 49/02* (2013.01); *F25B 13/00* (2013.01); *F25B 40/04* (2013.01); *F25B 2400/13* (2013.01)

(58) Field of Classification Search

CPC ..... F25B 2400/13; F25B 49/02; F25B 40/04; F25B 40/02; F28F 27/00; F28F 27/02; F24F 11/053; F24F 11/08

See application file for complete search history.

(56) References Cited

U.S. PATENT DOCUMENTS 4,321,797 A * 3/1982 Yaeger ..... F24D 17/02 62/238.6

8,539,789 B2 9/2013 Kopko et al.

(Continued)

FOREIGN PATENT DOCUMENTS

CN 201069292 6/2008
CN 201069292 Y * 6/2008

(Continued)

OTHER PUBLICATIONS

International Search Report & Written Opinion for International Application No. PCT/US2014/011510, dated Mar. 28, 2014.
CN201480004836.7 Office Action dated Jun. 8, 2016.

*Primary Examiner* — Jianying C Atkisson
*Assistant Examiner* — Meraj A Shaikh
(74) *Attorney, Agent, or Firm* — Fletcher Yoder, P.C.

(57) ABSTRACT

Air cooled chillers have auxiliary heat recovery systems that include a heat recovery heat exchanger for transferring heat from a compressed refrigerant to a process fluid. According to certain embodiments, the air cooled chillers also includes a compressor, a condenser, an expansion device, and a controller to govern operations of the expansion device, a fan in the condenser, and other components of the chiller system. The controller may receive signals from temperature and pressure sensors located throughout the chiller system in order to determine a heat recovery load of the heat recovery heat exchanger. The controller may govern operations of the condenser fan and the expansion device according to a low heat recovery mode, an intermediate heat recovery mode, or (Continued)

a full heat recovery mode. In full heat recovery mode, the controller operates the expansion device based on subcooling detected in the heat recovery heat exchanger.

22 Claims, 7 Drawing Sheets

(56) References Cited

U.S. PATENT DOCUMENTS

| | | | | |
|---|---|---|---|---|
| 9,869,466 | B2 * | 1/2018 | Thomson | F22B 1/16 |
| 2010/0242532 | A1 | 9/2010 | Kopko et al. | |
| 2011/0023515 | A1 * | 2/2011 | Kopko | F25B 1/10 62/222 |
| 2011/0036113 | A1 * | 2/2011 | Kopko | F25B 29/003 62/324.5 |
| 2011/0083454 | A1 * | 4/2011 | Kopko | F25B 49/027 62/115 |
| 2012/0151946 | A1 | 6/2012 | Decaestecker | |
| 2012/0312037 | A1 * | 12/2012 | Finney | B64D 13/06 62/115 |
| 2015/0047579 | A1 * | 2/2015 | Thomson | F24D 17/001 122/15.1 |

FOREIGN PATENT DOCUMENTS

| | | |
|---|---|---|
| CN | 201273702 | 7/2009 |
| CN | 101943471 | 1/2011 |

* cited by examiner

| MODE 70 | HOT-WATER LOAD 72 | HOT-WATER FLOW 74 | FAN CONTROL 76 | EEV CONTROL 78 | HOT-WATER VALVE CONTROL 80 |
|---|---|---|---|---|---|
| ZERO HEAT RECOVERY MODE 82 | NONE (ZERO) | OFF | CHILLER | COIL SUBCOOLING | NONE |
| LOW HEAT RECOVERY MODE 84 | LOW (0–50%) | ON | CHILLER | COIL SUBCOOLING | BYPASS HRHX AS TO MAINTAIN SUPPLY HOT WATER TEMPERATURE |
| INTERMEDIATE HEAT RECOVERY MODE 86 | INTERMEDIATE (50–80%) | ON | MINIMUM SPEED OF CHILLER OR HOT-WATER TEMPERATURE CONTROL | MAXIMUM OPENING BASED ON COIL SUBCOOLING AND HRHX SUBCOOLING | FULL FLOW TO HRHX WITH OVERRIDE BASED ON MINIMUM WATER TEMPERATURE LEAVING HRHX |
| FULL HEAT RECOVERY MODE 88 | HIGH (80–100%) | ON | HOT WATER TEMPERATURE CONTROL | HRHX SUBCOOLING CONTROL | FULL FLOW TO HRHX WITH OVERRIDE BASED ON MINIMUM WATER TEMPERATURE LEAVING HRHX |

FIG. 3

AIR COOLED CHILLER WITH HEAT RECOVERY

CROSS REFERENCE TO RELATED APPLICATIONS

This application is a national stage of PCT Application No. PCT/US2014/011510, entitled "AIR COOLED CHILLER WITH HEAT RECOVERY", filed on Jan. 14, 2014, which claims priority from and the benefit of U.S. Provisional Application Ser. No. 61/752,821, entitled "AIR COOLED CHILLER WITH HEAT RECOVERY", filed Jan. 15, 2013. Each of the foregoing applications is hereby incorporated by reference in its entirety.

BACKGROUND

The present disclosure relates generally to refrigeration systems employed for chiller applications, and, more specifically, to chiller systems that provide heat recovery.

Certain refrigeration and air conditioning systems rely on chillers to reduce the temperature of a process fluid, typically water. In such applications, the chilled water may be passed through downstream equipment, such as air handlers, to cool other fluids, such as air in a building. In typical chillers, the process fluid is cooled by an evaporator that absorbs heat from the process fluid by evaporating refrigerant. The refrigerant is then compressed by a compressor and transferred to a condenser. In the condenser, the refrigerant is cooled, typically by air or water flows, and recondensed into a liquid. Air cooled condensers typically comprise one or more condenser coils and one or more fans that induce airflow over the coils. Some systems may employ economizers to improve performance. In systems with flash tank economizers, the condensed refrigerant exiting the condenser coils is directed to a flash tank where the liquid refrigerant at least partially evaporates. The vapor may be extracted from the flash tank and returned to the compressor, while liquid refrigerant from the flash tank is directed to the evaporator, closing the refrigeration loop. In systems with heat exchanger economizers, the condensed refrigerant exiting the condenser coils is split into two flow streams that flow on the two sides of a heat exchanger. One of the two flow streams evaporates and cools the second stream. The flow stream that evaporates flows to the compressor while the other stream flows to the evaporator, closing the refrigeration loop.

In some conventional air-cooled chiller designs, heat recovery heat exchangers (HRHXs) may be utilized to provide auxiliary heating of water or other process fluids for use in the building. In such systems, the compressed refrigerant flows through the HRHX before entering the condenser in order to transfer heat to fluid that is circulated through the HRHX. If no fluid is circulated through the HRHX, then the refrigeration system may function as a typical air-cooled chiller. Unfortunately, as the demand for heat recovery increases, the refrigerant exiting the HRHX may become more condensed. This may decrease the amount of refrigerant vapor available for heat transfer through the condenser. As a result, the amount of liquid refrigerant in the condenser may increase, while the amount of liquid refrigerant in the evaporator decreases. This could lead to a loss of liquid refrigerant level in the evaporator, causing the refrigeration system to trip due to low suction pressure. In addition, as the desired heat recovery load increases, the system may be difficult to control using conventional chiller controls. For example, as the demand for heat recovery increases, conventional chiller control models may output condenser fans speeds that are below desired levels for promoting good heat transfer within the condenser. There is a need, therefore, for improved techniques for controlling chiller applications that include heat recovery systems.

DRAWINGS

FIG. 3 is a table illustrating various presently contemplated modes of operation of the system of FIG. 2, and how certain components may be controlled in the various modes;

DETAILED DESCRIPTION

The present disclosure is directed to systems and methods for controlling an air cooled chiller with auxiliary heat recovery. The system may include, among other things, a compressor, condenser, expansion device, economizer, and evaporator for circulating refrigerant, as well as a heat recovery heat exchanger that transfers heat from the refrigerant to heat a process fluid. A controller controls the expansion device and a condenser fan based on sensor feedback in order to provide a desired amount of heat recovery. The system may be particularly beneficial in chillers employing microchannel air-cooled condenser that have a relatively small interior refrigerant volume and shell side evaporators that have a relatively large interior refrigerant volume. According to certain embodiments, the techniques described herein may be designed to provide smooth control from zero to 100% heat recovery from the refrigeration system.

Figure 1:
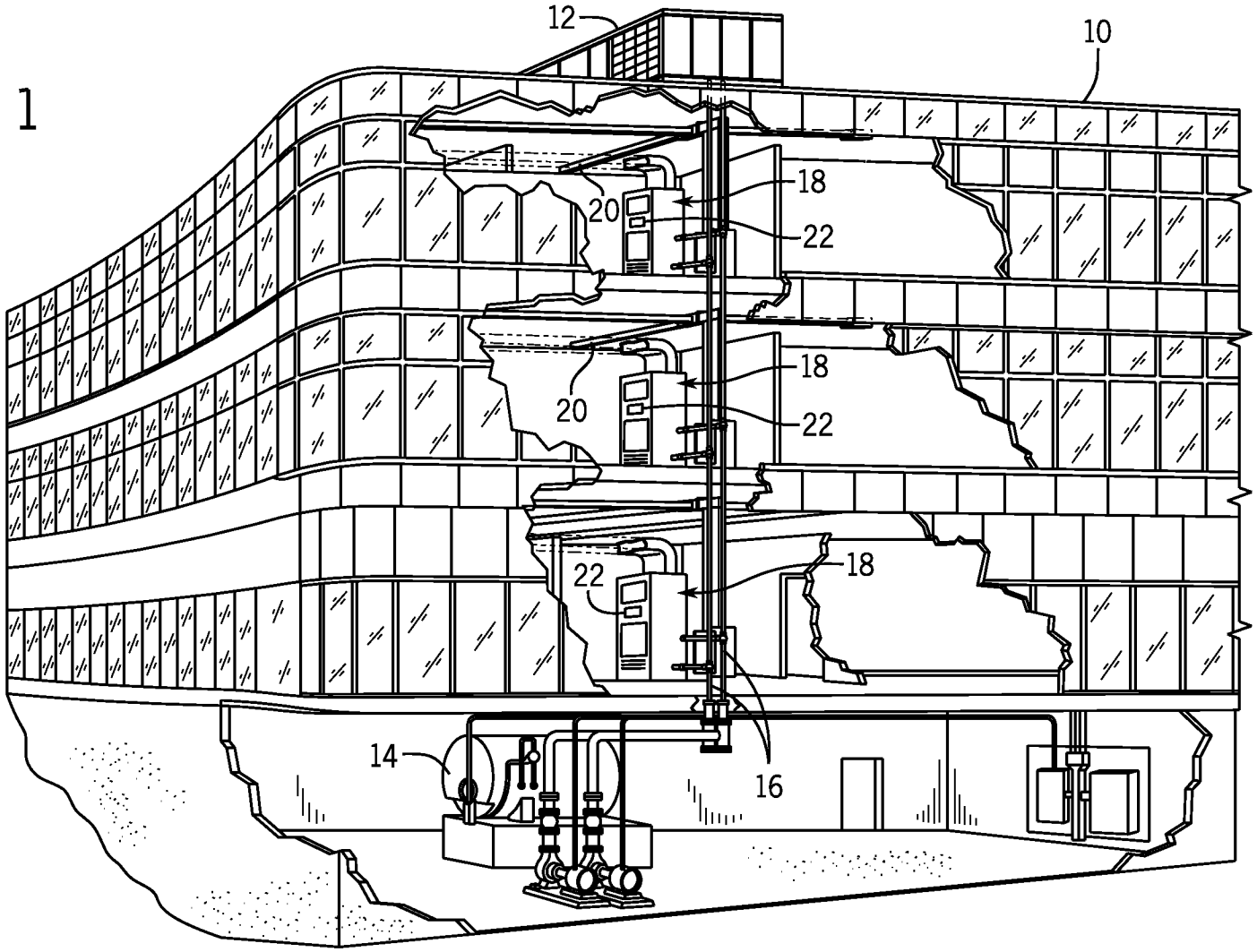
FIG. 1 is an illustration of an exemplary embodiment of a commercial heating ventilating, air conditioning and refrigeration (HVAC&R) system that includes an air cooled refrigeration system in accordance with aspects of the present techniques.

FIG. 1 depicts an exemplary application for a refrigeration system. Such systems, in general, may be applied in a range of settings, both within the HVAC&R field and outside of that field. The refrigeration systems may provide cooling to data centers, electrical devices, freezers, coolers, or other environments through vapor-compression refrigeration, absorption refrigeration, or thermoelectric cooling. In presently contemplated applications, however, refrigeration systems may be used in residential, commercial, light industrial, industrial, and in any other application for heating or cooling a volume or enclosure, such as a residence, building, structure, and so forth. Moreover, the refrigeration systems may be used in industrial applications, where appropriate, for basic refrigeration and heating of various fluids.

FIG. 1 illustrates an exemplary application, in this case an HVAC&R system for building environmental management that may employ heat exchangers. A building 10 is cooled by a system that includes a chiller 12 and a boiler 14. As shown, chiller 12 is disposed on the roof of building 10 and boiler 14 is located in the basement; however, the chiller and boiler may be located in other equipment rooms or areas next to the building. Chiller 12 is an air cooled or water cooled device that implements a refrigeration cycle to cool water. Chiller 12 is housed within a single structure that includes a refrigeration circuit and associated equipment such as pumps, valves, and piping. For example, chiller 12 may be a single package rooftop unit. Boiler 14 is a closed vessel in which water is heated. The water from chiller 12 and boiler 14 is circulated through building 10 by water conduits 16. Water conduits 16 are routed to air handlers 18, located on individual floors and within sections of building 10.

Air handlers 18 are coupled to ductwork 20 that is adapted to distribute air between the air handlers and may receive air from an outside intake (not shown). Air handlers 18 include heat exchangers that circulate cold water from chiller 12 and hot water from boiler 14 to provide heated or cooled air. Fans, within air handlers 18, draw air through the heat exchangers and direct the conditioned air to environments within building 10, such as rooms, apartments, or offices, to maintain the environments at a designated temperature. A control device, shown here as including a thermostat 22, may be used to designate the temperature of the conditioned air. Control device 22 also may be used to control the flow of air through and from air handlers 18. Other devices may, of course, be included in the system, such as control valves that regulate the flow of water and pressure and/or temperature transducers or switches that sense the temperatures and pressures of the water, the air, and so forth. Moreover, control devices may include computer systems that are integrated with or separate from other building control or monitoring systems, and even systems that are remote from the building.

Figure 2:
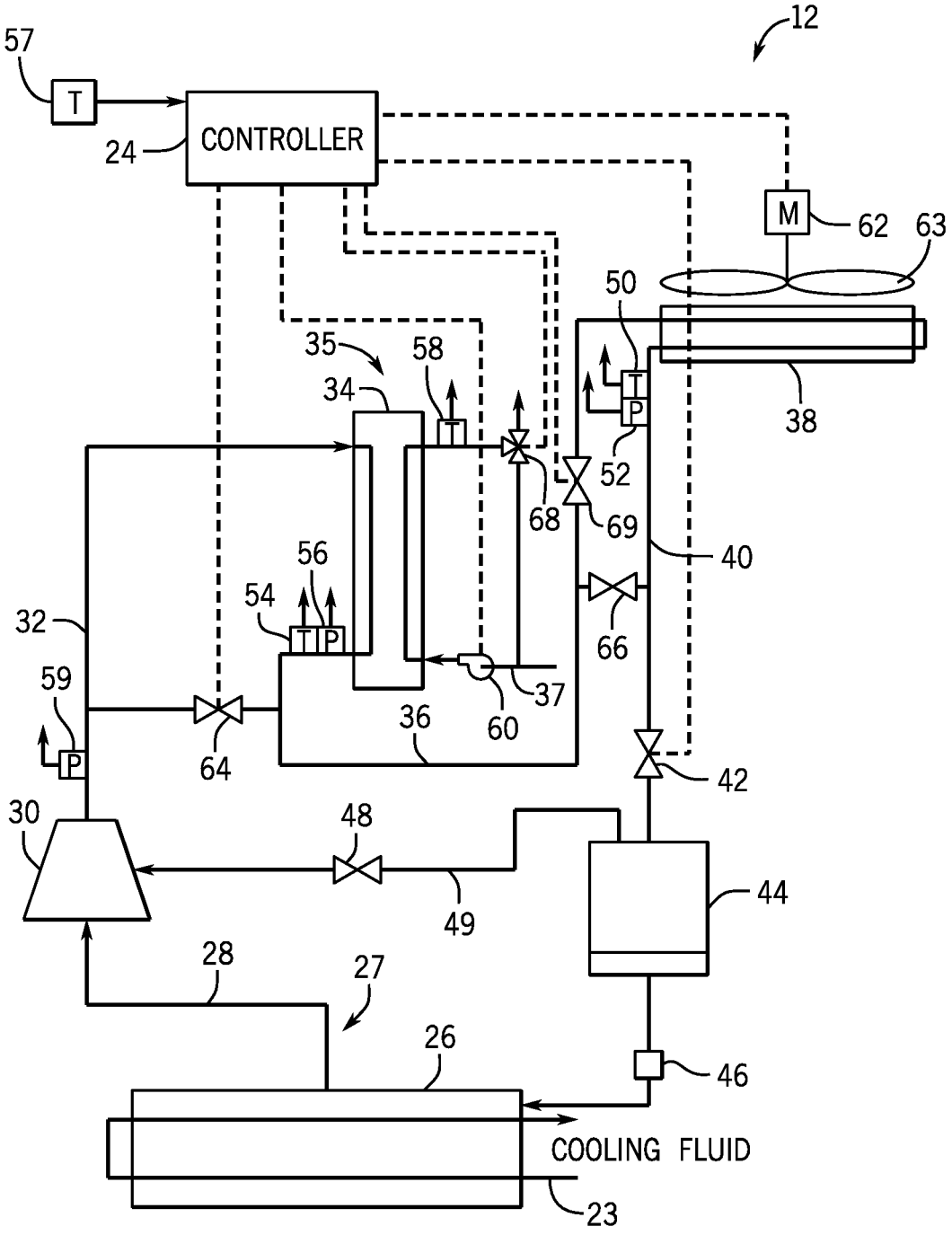
FIG. 2 is a diagrammatical representation of an exemplary HVAC&R system in accordance with the present techniques.

FIG. 2 schematically depicts an embodiment of chiller 12, which incorporates a heat recovery system and may be controlled by a controller 24. As discussed further below, the heat recovery system may provide an auxiliary function that heats a liquid using some or all of the heat normally rejected to the environment by chiller 12. Chiller 12 includes a cooling fluid loop 23 that circulates a cooling fluid, such as chilled water, an ethylene glycol-water solution, brine, or the like, to a cooling load, such as a building, piece of equipment, or environment. For example, cooling fluid loop 23 may circulate the cooling fluid to water conduits 16 shown in FIG. 1. In certain embodiments, the cooling fluid may circulate within the cooling fluid loop 23 to a cooling load, such as a research laboratory, computer room, office building, hospital, molding and extrusion plant, food processing plant, industrial facility, machine or any other environments or devices in need of cooling.

Warm fluid from cooling fluid loop 23 enters an evaporator 26 and is cooled, generating chilled fluid that can be returned to the cooling load. In cooling the fluid, evaporator 26 transfers heat from the cooling fluid loop 23 to refrigerant flowing within a closed refrigerant loop 27. The refrigerant may be any fluid that absorbs and extracts heat. For example, the refrigerant may be a hydrofluorocarbon (HFC) based R-410A, R-407C, or R-134a, or it may be carbon dioxide (R-744) or ammonia (R-717) or hydrofluoroolefin (HFO) based. As the refrigerant flows through evaporator 26, the refrigerant is vaporized. The vaporized refrigerant then exits evaporator 26 and flows through a suction line 28 into a compressor system 30, which may be representative of one or more compressors. The refrigerant is compressed in compressor system 30 and exits through one or more compressor discharge lines 32.

The compressed refrigerant then flows through a heat recovery heat exchanger (HRHX) 34 of a heat recovery system 35. Heat recovery system 35 includes HRHX 34 and a heat recovery fluid loop 37 that circulates a heat recovery fluid, such as water or brine, through HRHX 34. As the heat recovery fluid flows through HRHX 34, the heat recovery fluid absorbs heat from the refrigerant flowing through HRHX 34 to produce warmed heat recovery fluid. According to certain embodiments, the warmed heat recovery fluid may be circulated within the building 10 (FIG. 1) to provide auxiliary heating of water or another liquid for use in the building 10.

From HRHX 34, the refrigerant then travels through line 36 of refrigerant loop 27 and flows through condenser 38 where the refrigerant is further cooled and condensed to a liquid. The condensed refrigerant exits condenser 38 through liquid line 40 of refrigerant loop 27, which directs the refrigerant through an expansion valve 42 to a flash tank 44. According to certain embodiments, the expansion valve 42 may be a thermal expansion valve or electronic expansion valve that is operated by controller 24 to vary refrigerant flow in response to suction superheat, evaporator liquid level, or other parameters. According to certain embodiments, an economizing heat exchanger could be used instead of the flash tank 44. Within flash tank 44, the liquid phase refrigerant may separate from the vapor phase refrigerant and collect within a lower portion of flash tank 44. The liquid phase refrigerant may then exit flash tank 44 and flow through an orifice 46 to evaporator 26, completing the cycle.

Figure 7:
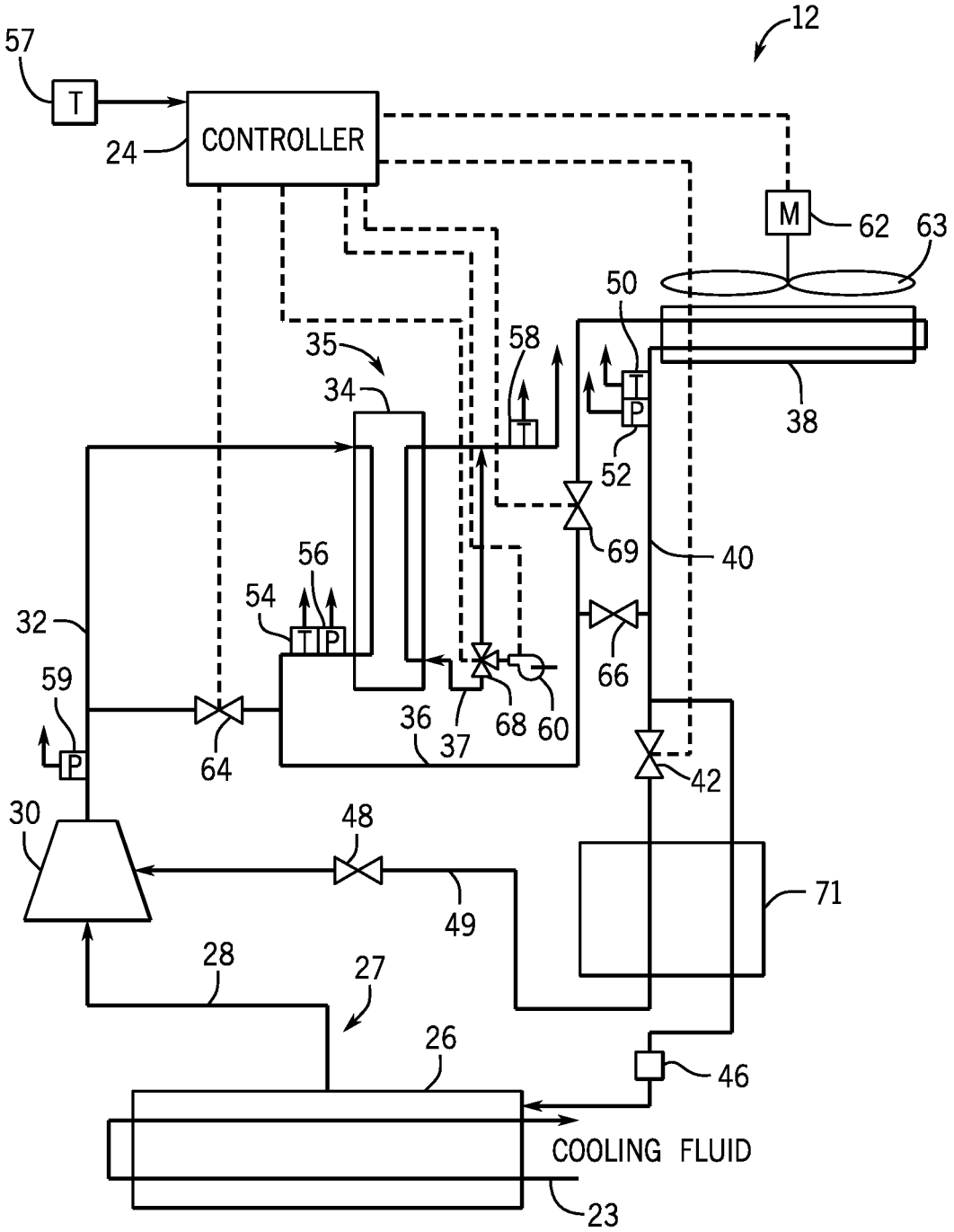
FIG. 7 is a diagrammatical representation of an exemplary HVAC&R system including a heat exchanger economizer in accordance with the present techniques.

The vapor phase refrigerant exits flash tank 44 through an economizer line 49 that directs the vapor phase refrigerant to compressor system 30. An economizer valve 48 located in economizer line 49 may be employed to control the return of refrigerant vapor to the compressor system 30. Through economizer line 49, the refrigerant vapor exiting the flash tank 44, which is at a higher pressure than the refrigerant vapor entering the compressor system 30 from the evaporator 26, may be introduced into the compressor system 30. The compression of the higher pressure refrigerant vapor from the flash tank 44 may increase the efficiency and capacity of the refrigeration system. While economizers are typically used with screw-type compressors, similar configurations may be employed with other compressor configurations, such as reciprocating, scroll, or multistage centrifugal compressors, for example. Further, in other embodiments, flash tank 44 and economizer line 49 may be omitted so that all refrigerant exiting condenser 38 flows to evaporator 26. Further, in other embodiments, the flash tank 44 may be replaced by a heat exchanger economizer 71, as illustrated in FIG. 7.

As shown in FIG. 2, evaporator 26 is a shell and tube evaporator where the refrigerant flows through the shell side of the evaporator while the fluid to be cooled flows through tubes within the evaporator. According to certain embodiments, evaporator 26 may be a falling film evaporator, flooded evaporator, or a hybrid of a falling film and flooded evaporator. Further, in certain embodiments, evaporator 26 could be a shell and tube evaporator where the refrigerant flows through the tubes within the evaporator while the fluid to be cooled flows through the shell side. In yet other embodiments, evaporator 26 could be a plate heat exchanger where the refrigerant and fluid to be cooled flows in channels formed by closely located plates. Further, in certain embodiments, condenser 38 may be an air cooled, microchannel condenser. In these embodiments, the refrigerant may be circulated through microchannel tubes of the condenser, and thus, the condenser may have a relatively small refrigerant volume compared to refrigerant volume available in the shell side of the evaporator. The relatively small refrigerant volume in the condenser with respect to the evaporator may allow the refrigeration system to maintain an appropriate level of liquid refrigerant in evaporator 26, even when the condenser 38 is filled with primarily liquid refrigerant. Such a condition may occur when a demand for heat recovery is very high (e.g., near 100% of the chiller heat rejection). In these situations, the refrigerant exiting HRHX 34 may be mostly or completely condensed and accordingly, condenser 38 may receive primarily liquid phase refrigerant.

In the illustrated embodiment, a temperature sensor 50 and a pressure transducer 52 are disposed in the liquid line 40 that extends between condenser 38 and flash tank 44. As summarized below, a temperature and pressure monitored by these sensors 50 and 52 may be used by controller 24 to calculate the amount of subcooling for the refrigerant exiting condenser 38. Similarly, a temperature sensor 54 and a pressure transducer 56 are located in line 36, which extends between HRHX 34 and condenser 38. The temperature and pressure monitored by these sensors 54 and 56 may be used by controller 24 to determine the amount of subcooling for the refrigerant exiting HRHX 34. Heat recovery system 35 also includes another temperature sensor 58 that measures the temperature of the heat recovery fluid exiting HRHX 34. Further, a pressure transducer 59 disposed in compressor discharge lines 32 provides a pressure measurement that may be used to operate certain controls of the refrigeration system.

As shown in FIG. 2, HRHX 34 uses a portion of the heat normally rejected to the environment through coils 38 for auxiliary heating functions (e.g., heating water or other fluids for use in building 10). Accordingly, the inclusion of heat recovery system 35 in chiller 12 allows chiller 12 to both cool a process fluid for circulation through cooling fluid loop 23 and to heat a heat recovery fluid for circulation through heat recovery loop 37. This may be especially useful for providing simultaneous heating and cooling for hotels, hospitals, process industries, and other applications having multiple demands for both heating and cooling.

Although the HRHX 34 may be used to heat any suitable heat recovery fluid pumped therethrough, the following discussion is directed to embodiments of the refrigeration system in the context of heating water for use in a building (e.g., building 10). In these embodiments, water is pumped through HRHX 34 by a pump 60, and the refrigerant flowing through the HRHX 34 heats the water to a desired temperature. Controller 24 governs operation of a motor 62 that drives one or more condenser fans 63 at an appropriate fan speed. Controller 24 also may regulate the opening of expansion valve 42 to an appropriate position based on a desired amount of heat recovery for the auxiliary heating function.

Chiller 12 also includes an optional heat recovery bypass valve 64 and a condenser bypass valve 66 that may be opened or closed electronically by controller 24 in response to a given heat recovery demand on the system. For example, when auxiliary heat is not desired, bypass valve 64 may be opened to direct the refrigerant exiting compressor through bypass line 65 to line 36, allowing the refrigerant to bypass heat recovery system 35. In another example, when heat recovery system 35 is operating at or close to full capacity, bypass valve 66 may be opened to direct the refrigerant exiting HRHX 34 to expansion valve 42, allowing the refrigerant to bypass condenser 38. In certain modes of operation, a three-way heat recovery valve 68 may be opened to regulate the temperature of water flowing through HRHX 34. For example, valve 68 may be placed in a recycle position where heated water exiting HRHX 34 is re-circulated through HRHX 34 to increase the heat transferred to the water. When the desired water temperature is achieved, valve 68 may then be placed in a building return position where the heated water exiting HRHX 34 is returned to the building to provide auxiliary heating. The chiller 12 may also include an optional valve 69 between the heat recovery heat exchanger 34 and the condenser 38. This optional valve 69 could be controlled to ensure two-phase refrigerant flow in order to prevent the condenser 38 from filling with refrigerant liquid, which can result in low suction pressure and other operational problems. At that same time, pressure drop through the optional valve 69 should not be too high to ensure adequate flow of liquid through valve 42. This optional valve 69 may be desirable depending on the internal volume of condenser 38 compared to the refrigerant charge. That is, the optional valve 69 may be deleted if the internal volume is small enough to allow condenser 38 to fill completely with refrigerant liquid without operational problems.

The operation of valves 64, 66, 68, and 69, as well as other components, such as valves 42 and 48 and motor 62, may be governed by controller 24 to achieve a relatively accurate, continuous, and smooth control of the system for a desired range of zero to 100% heat recovery. That is, controller 24 may control expansion valve 42 and the condenser fan speed (via motor 62) such that a desired amount of heat from the refrigerant may be recovered between the compressor system 30 and the condenser 38. Depending on the heat recovery load, controller 24 may operate in different modes, described in detail below, for controlling the various components.

It should be noted that although one HRHX 34 is included in the illustrated refrigeration system, in other embodiments, multiple HRHXs may be included in heat recovery system 35 to provide auxiliary heating to multiple applications. The multiple HRHXs may be connected in series, in parallel, or a combination thereof and may circulate multiple heat recovery fluids. In these embodiments, the heat recovery system 35 may include multiple pumps 60 and/or multiple three-way heat recovery valves 68 that may be operated independently of one another via controller 24 to supply water, or other heat recovery fluids, at desired temperatures to multiple applications with one or more desired heating loads.

Controller 24 may execute hardware or software control algorithms to regulate operation of chiller 12 and the associated heat recovery system 35. According to exemplary embodiments, controller 24 may include an analog to digital (A/D) converter, one or more microprocessors or general or special purpose computers, a non-volatile memory, memory circuits, and an interface board. For example, the controller may include memory circuitry for storing programs and control routines and algorithms implemented for control of the various system components, such as fan motor 62 or expansion valve 42 between condenser 38 and flash tank 44. Controller 62 also includes, or is associated with, input/output circuitry for receiving sensed signals from input sensors 50, 52, 54, 56, and 58, and interface circuitry for outputting control signals for valves 42, 48, 64, 66, 68, 69, and motor 62. For example, the controller will also typically control, for example, valving for economizer line 49, speed and loading of compressor 30, and so forth, and the memory circuitry may store set points, actual values, historic values and so forth for any or all such parameters. Other devices may, of course, be included in the system, such as additional pressure and/or temperature transducers or switches that sense temperatures and pressures of the refrigerant, the heat exchangers, the compressor, the flash tank, the inlet and outlet air, and so forth. Further, other values and/or set points based on a variety of factors, such as system capacity, cooling load, and the like may be used to determine when to operate heat recovery system 35. Controller 24 also may include components for operator interaction with the system, such as display panels and/or input/output devices for checking operating parameters, inputting set points and desired operating parameters, checking error logs and historical operations, and so forth.

As summarized below, controller 24 collects data, such as temperature and pressure data for the refrigerant in lines 36 and 40, located between HRHX 34 and condenser 38 and between condenser 38 and flash tank 44, respectively. Controller 24 may then use this data to govern operation of chiller 12, such as the opening and closing of expansion valve 42, which provides refrigerant to the flash tank 44. The controller also may govern operation of chiller 12 based on other parameters, such as the temperature of water exiting HRHX 34 or the compressor capacity, which may be determined, for example, by monitoring and controlling the speed of compressor 30. Further parameters that may be used as inputs by controller 24 for governing operation of chiller 12 may include ambient air temperature, condensing pressure, economizer operation (i.e., whether the economizer is operating and at what rate), evaporating pressure, and fan operation (i.e., whether one or more fans associated with the condenser 24 is operating and at what condition or speed).

FIG. 3 is a table illustrating various presently contemplated modes of operation 70 of the system of FIG. 2, and how certain components may be controlled in these modes. Each mode is representative of a range of heat recovery loads 72 for auxiliary heating applications and the appropriate control logic applied by the controller 24 in response to the heat recovery load 72. The heat recovery load 72 may be a percentage of the total heat available from the refrigerant flowing through the chiller 12. This total available heat may be equal to an amount of heat transferred from the cooling fluid to the refrigerant via the evaporator 26 added to an amount of power input to the compressor 30 for compressing the refrigerant. The heat recovery load 72 may be determined by comparing an amount of heat transferred through the HRHX 34 to this total available heat. The heat transferred from the compressed refrigerant to the process fluid via the HRHX 34 is directly related to a mass flow rate of the process fluid flowing through the HRHX 34 and a temperature difference of the process fluid between entering and exiting the HRHX 34. In certain embodiments, the mass flow rate and temperature of the process fluid entering the HRHX 34 remain constant, such that the heat recovery load on the chiller 12 may be determined entirely based on the measured temperature of the process fluid exiting the HRHX 34, as measured by temperature sensor 58. As heat recovery begins, this measured temperature may be approximately equal to the temperature of the process fluid entering the HRHX 34, such that the heat recovery load 72 is approximately 0% heat recovery. The heat recovery mode of operation 70 may be related to a temperature set point representative of a desired temperature (e.g., input by an operator) for the heated process fluid. The controller 24 may compare the measured temperature from temperature sensor 58 to the temperature set point, and when the measured temperature is below the temperature set point, the controller determines that there is a heat recovery demand. In this way, there may be a demand for heat recovery even when the heat recovery load 72 is approximately 0%. As the HRHX 34 facilitates heat transfer from the compressed refrigerant to the process fluid, the temperature of the process fluid exiting the HRHX 34 increases, thereby increasing the temperature measured by temperature sensor 58 and the determined heat recovery load 72. Until the measured temperature reaches the temperature set point, the controller 24 controls components of the chiller 12 according to one or more of the different heat recovery modes of operation 70 described in detail below. The controller 24 is configured to determine the appropriate heat recovery mode 70 based on the measured temperature of the process fluid exiting the HRHX 34. In addition, the controller 24 is configured to smoothly transition between the different heat recovery modes 70 as the heat recovery load 72 increases (e.g., from 0 to 100% heat recovery), until the measured temperature reaches the desired set point.

Each mode 70 may employ different control logic when the heat recovery load 72 falls within a given range. The different control schemes are detailed in the other columns of FIG. 3, which describe the hot-water flow setting 74, the type of fan control 76, the type of expansion valve control 78, and the type of hot-water valve control 80 that may be employed for each of the respective modes 70. Together, the hot-water flow setting 74, the type of fan control 76, the type of expansion valve control 78, and the type of hot-water valve control 80 form the logic used by controller 24 when operating in a particular mode 70. The hot-water flow setting 74 specifies for each mode whether the pump 60 is pumping water through the HRHX 34. The flow rate of water from pump 60 may be controlled and monitored through another process (e.g., a different controller) that is not based on heat recovery load 72. In certain embodiments, however, controller 24 may control the flow rate of water from pump 60 based on heat recovery load 72. Likewise, the type of fan control 76 specifies the processing that may be used to determining an appropriate fan speed based on the desired amount of heat recovery. In addition, the type of expansion valve control 78 and the type of hot-water valve control 80 specify the type of control logic or algorithms used to determine the appropriate position of the expansion valve 42 and the three-way heat recovery valve 68, respectively, based on the heat recovery load.

The controller 24 may operate in four different modes based on the desired amount of heat recovery: zero heat recovery mode 82, low heat recovery mode 84, intermediate heat recovery mode 86, and full heat recovery mode 88. Each mode 70 may be indicative of a given range of heat recovery loads (e.g., low heat recovery mode for zero to 50% heat recovery). In the zero heat recovery mode 82, there is no heat recovery load applied to the refrigeration system, and therefore the hot-water flow from the pump 60 may be turned off, either manually or automatically by the controller 24.

In zero heat recovery mode 82, the controller operates the motor 62 at a fan speed appropriate for normal chiller operations. The term "normal chiller operations" may refer to operating the condenser fan motor 62 at a fan speed that is determined based at least in part on an ambient air temperature detected using a temperature sensor 57. Ambient temperature may affect how the controller 24 adjusts fan operation during periods of relatively high ambient temperature. As ambient temperature increases, less heat is transferred from the condenser refrigerant to the outside air because of the reduced temperature differential. This situation may result in increased refrigerant temperature within the condenser 38. As the temperature of the refrigerant increases, the pressure within the condenser coils may also increase. It is generally undesirable to operate the condenser coils above certain pressures. Thus, the controller 24 may automatically increase fan speed of the motor 62 in response to a high ambient temperature. The increased fan speed may facilitate additional heat transfer from the refrigerant to the outside air, thus reducing condenser pressure. In order to achieve increased chiller efficiency, normal chiller operations also may include adjusting the fan speed to reduce a combined amount of power input to the compressor 30 and power input to the fan motor 62. The power of the compressor 30 may be calculated by the controller 24 based on a known capacity of the compressor 30 and a pressure of the refrigerant exiting the compressor, as monitored by pressure transducer 59.

In the zero heat recovery mode 82, the expansion valve may be opened by the controller 24 to a position for maintaining a desired and substantially constant subcooling of the refrigerant exiting the condenser coils 38. The controller 24 may continually monitor the refrigerant subcooling as determined from temperature and pressure values measured by sensors 50 and 52. This may maintain a relatively constant amount of liquid in the condenser coils 38, which is appropriate for zero and low heat recovery requirements, but less than optimal for allowing large amounts of heat recovery from the refrigeration system. Because no hot water is pumped through the HRHX 34 when operating in the zero heat recovery mode 82, control of the three-way heat recovery valve 68 is not employed.

It should be noted that the illustrated ranges of hot-water load 72 for the modes 70 are representative and may be different for different chiller designs. That is, other embodiments of chiller 12 may be designed such that the controls outlined in FIG. 3 are desired at different ranges of heat recovery loads. For example, the ranges of hot-water load 72 for chillers 12 operating in low heat recovery mode 84 may vary (e.g., 0-30%, 0-40%, 0-60%, etc.) with the particular chiller 12. Similarly, the ranges of hot-water load 72 for chillers 12 operating in intermediate heat recovery mode 86 may vary (e.g., 30-80%, 40-95%, 60-75%, etc.). Likewise, the ranges of hot-water load 72 for chillers 12 operating in full heat recovery mode 88 may vary (e.g., 75-100%, 80-100%, 95-100%, etc.). In other words, the low heat recovery mode may have a range of percentages between 0 and a first threshold value, and the intermediate heat recovery mode may have a range of percentages between the first threshold value and a second threshold value that is greater than the first but less than 100%. The full heat recovery modes may have a range of percentages above the second threshold value. The hot-water load 72 may therefore be divided into any appropriate ranges for applying the specified control mode 70.

Low heat recovery mode 84 is the operating mode of the controller 24 when the demanded heat recovery is within a range of approximately zero to 50% heat recovery. That is, zero to 50% of the total heat to be rejected from the refrigerant between compressor system 30 and evaporator 26 is desired for an auxiliary heating function, facilitated by the HRHX 34. In this mode, the pump 60 is operating and, therefore, the hot-water flow 74 is ON. Similar to the previous mode, the fan control 76 is based on typical chiller operations and the expansion valve control is determined based on condenser coil subcooling monitored by sensors 50 and 52. However, unlike the previous mode of operation, low heat recovery mode 84 controls the three-way heat recovery valve 68 to bypass the HRHX 34 in order to maintain the temperature of the water supplied to the HRHX. That is, heated water exiting the HRHX 34 is sent directly to the desired heating application and not fed back toward the pump 60. In zero or low heat recovery modes, the heat recovery bypass valve 64 may be opened to improve system performance by reducing the pressure drop of refrigerant flowing through the HRHX 34 and reducing accumulation of oil within the HRHX 34.

It should be noted that both zero heat recovery mode 82 and low heat recovery mode 84 incorporate similar controls for both fan speed and expansion valve opening. Exemplary control of fan speed and expansion valve opening of such chiller systems is described in U.S. patent application Ser. No. 12/751,475, entitled "CONTROL SYSTEM FOR OPERATING CONDENSER FANS," to Kopko et al., filed on Mar. 31, 2010; and U.S. patent application Ser. No. 12/846,959, entitled "REFRIGERANT CONTROL SYSTEM AND METHOD," to Kopko et al., filed on Jul. 30, 2010, which are both incorporated into the present disclosure by reference.

The refrigeration system and controller 24 are designed to provide up to 100% heat recovery through the HRHX 34. In full heat recovery mode 88, the hot-water flow is indicated as ON since the pump 60 is pumping water through the HRHX 34. Unlike the previous modes, however, the fan control is based on the temperature of hot water exiting HRHX 34, as measured by temperature sensor 58. When this hot water temperature increases, the controller decreases the condenser fan speed to account for the lower amount of heat to be rejected from the refrigerant in the condenser coils 38. At 100% heat recovery, the fan(s) 63 will be turned off altogether so that the refrigerant flows through the coils without losing additional heat before entering the expansion valve 42. In full heat recovery mode 88, the controller 24 opens the expansion valve 42 to a position based on the subcooling of refrigerant exiting HRHX 34, instead of the condenser coils 38. That is, the opening of the expansion valve 42 will be selected to maintain a constant subcooling of the refrigerant from the HRHX 34, e.g., based on a subcooling set point of approximately 5-10° F. Three-way heat recovery valve 68 is opened to allow hot water exiting the HRHX 34 to reenter the HRHX 34 until the water temperature leaving the HRHX 34, measured by sensor 58, reaches a threshold. This allows water to repeatedly cycle through the HRHX 34 until the desired temperature is reached, making the same HRHX structure efficient for low heat recovery applications as well as high heat recovery applications.

Because heat rejection through the condenser 38 is relatively low in full heat recovery mode 88, optional coil bypass valve 66 may be opened to reduce a pressure drop of liquid refrigerant flowing through the coils of the condenser 38. The same effect may be achieved by opening a bypass valve (not shown) around the expansion valve 42. In this case, the bypass valve may be sized such that an appropriate flow capacity through the expansion valve 42 is realized. That is, when the expansion valve is nearly or fully opened, the bypass valve may be opened, and when the expansion valve is nearly closed, the bypass valve may be fully closed.

Between low and full heat recovery modes 84 and 88, the controller 24 operates the refrigeration system in intermediate heat recovery mode 86. For such intermediate conditions, the controls are set based on a combination of the control logic used for low heat recovery and full heat recovery. A fan speed is calculated based on the chiller controls used in low heat recovery mode 84, another fan speed is calculated based on the hot-water temperature measured by sensor 58, and the controller 24 drives the fan(s) 63 at the lower of the two calculated fan speeds. Similarly, positions for the expansion valve 42 are calculated based on both the subcooling of refrigerant leaving condenser coils 38 and subcooling of refrigerant leaving HRHX 34, and the expansion valve is opened to the larger of the two openings. The three-way heat recovery valve 68 may be initially opened to allow full flow to HRHX 34 until the temperature of water exiting the HRHX reaches a threshold value, similar to the operation in full heat recovery mode 88. In certain embodiments, if the pressure drop through condenser coils 38 is sufficiently low, the expansion valve control 78 may be based entirely on subcooling of refrigerant leaving the condenser 38, without transitioning to different control as the heat recovery load increases.

Figure 4:
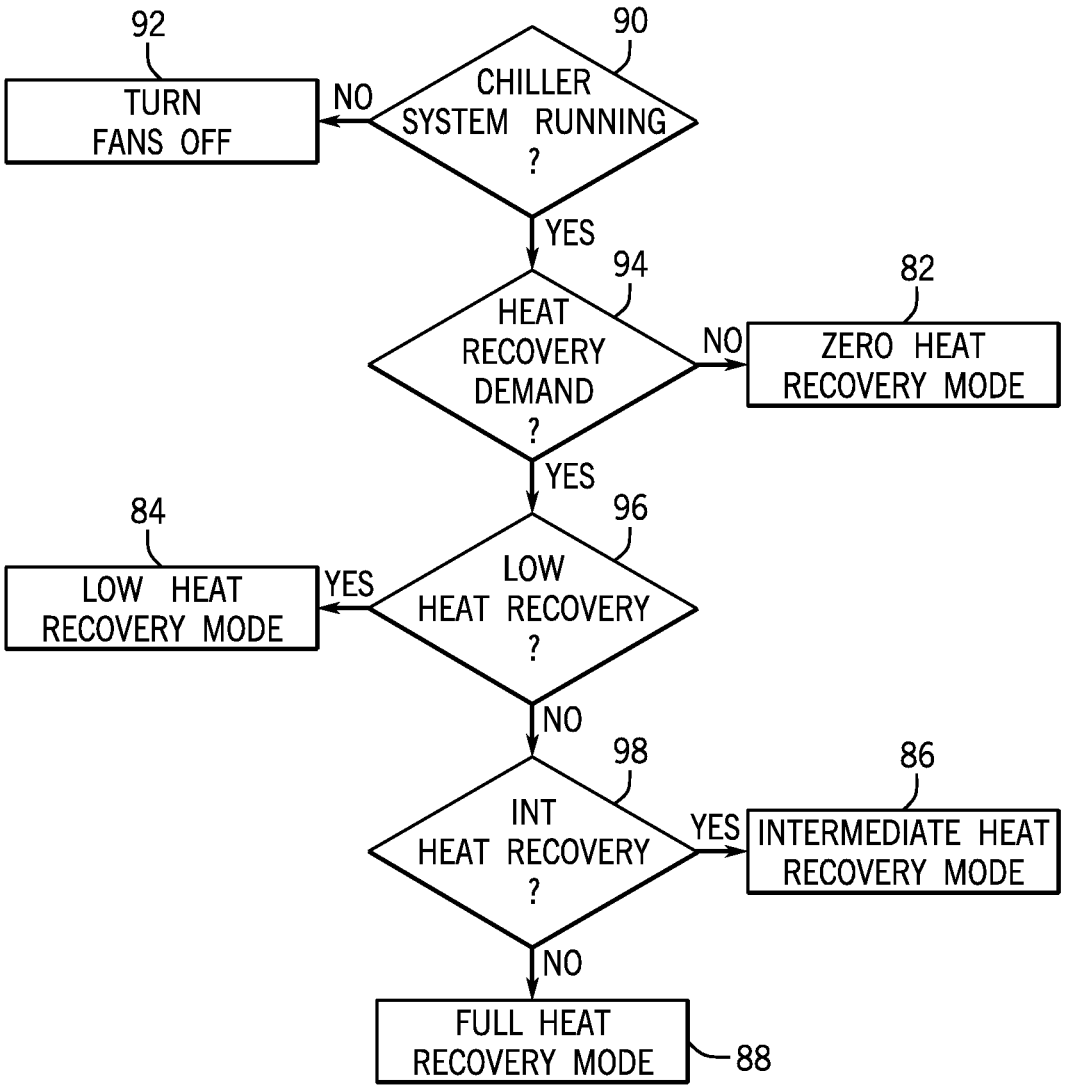
FIG. 4 is a flowchart of a method for responding to various heat recovery loads on the system of FIG. 2.

FIG. 4 is a flowchart depicting an exemplary method for operating the refrigeration system. The method begins by determining (block 90) if the chiller system is running. If the chiller system is not running, the controller 24 may turn off (block 92) the condenser fan(s) 63. If the chiller system is running, the controller 24 determines (block 94) if there is a demand for heat recovery from the HRHX 34 of the chiller system. The controller 24 may determine a heat recovery demand by comparing a temperature set point to a sensed temperature. For example, controller 24 may receive a signal from temperature sensor 58 indicative of the current temperature of the auxiliary water heated by HRHX 34. Controller 24 may compare this current temperature with a temperature set point stored in controller 24 (e.g., previously input by an operator or a preset value stored in memory). If the sensed temperature is not as high as the temperature set point, a heat recovery demand exists, and the controller 24 determines the demand for heat recovery. If a heat-recovery demand does not exist, the controller 24 operates the chiller system in zero heat recovery mode 82, as previously described. The controller may also turn off pump 60 and open heat recovery bypass valve 64, if present, to reduce pressure drop of refrigerant through the HRHX 34. If a heat recovery demand is detected, the controller 24 determines (block 96) whether the heat recovery load 72 is low. If the load is low, the controller 24 operates the fan speed, expansion valve position, and three-way hot water valve position according to the low heat recovery mode 84 as specified in FIG. 3. If the heat recovery demand is not low, the controller 24 determines (block 98) if the heat recovery load falls within the intermediate range of heat recovery values. The controller 24 then operates the chiller in intermediate heat recovery mode 86 or full heat recovery mode 88, depending on the heat recovery load 72. In full heat recovery mode 88, the controller 24 may turn the fan(s) off entirely.

Figure 5:
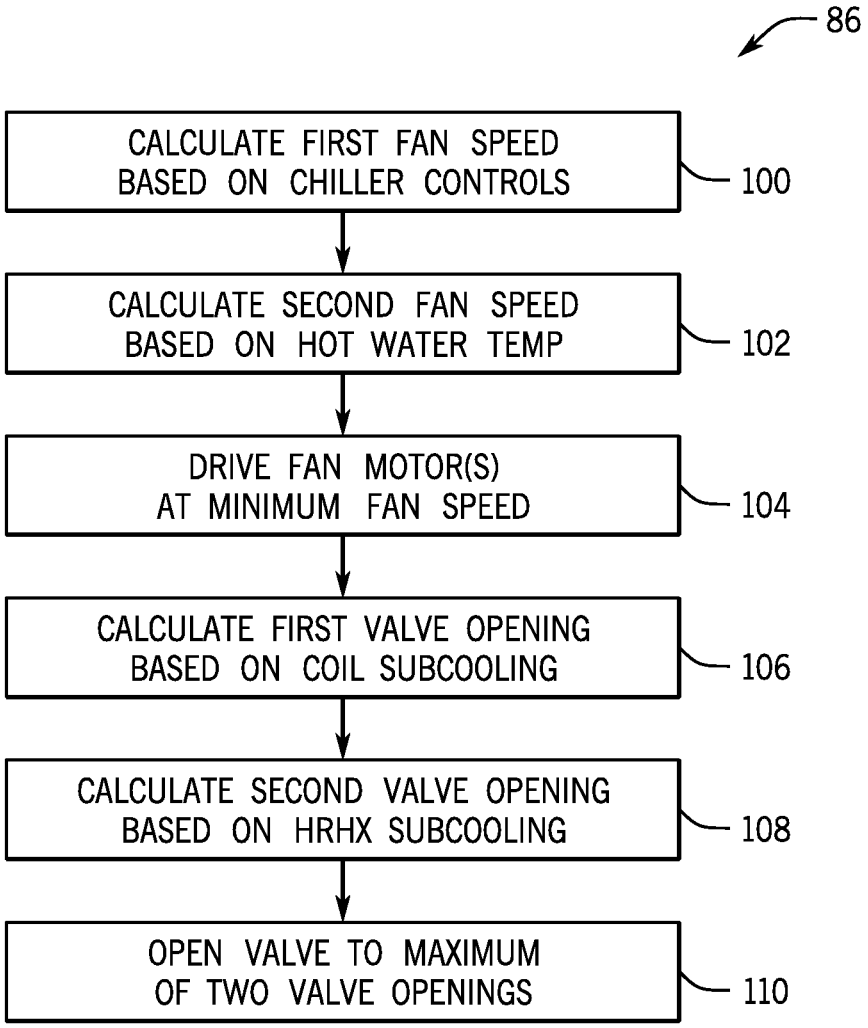
FIG. 5 is a flowchart of a method for operating the system of FIG. 2 in intermediate heat recovery mode.

FIG. 5 is a flowchart depicting an exemplary method for operating the refrigeration system in intermediate heat recovery mode 86. Unlike in low and full heat recovery modes, the fan speed and expansion valve position are not controlled according to readings from the same set of sensors for the full range of intermediate heat recovery loads. First the controller 24 calculates (block 100) a first fan speed based on chiller controls. That is, the same control logic used to determine fan speed in low heat recovery mode 84 will be used to calculate a potential fan speed in the intermediate heat recovery mode. Then, the controller calculates (block 102) a second fan speed based on the temperature of hot water leaving HRHX 34, according to the same control logic used in full heat recovery mode 88. The controller 24 drives (block 104) the fan motor(s) 62 at the minimum of the two calculated fan speeds. In order to also control a position of the expansion valve 42, the controller 24 calculates a first valve opening (block 106) based on subcooling of the condenser coils 38 and a second valve opening (block 108) based on subcooling of refrigerant leaving the HRHX 34. Then, the expansion valve 42 is opened (block 110) by controller 24 to a maximum of the two calculated valve openings. In this way, the expansion valve position may be controlled independently from the fan speed in the intermediate heat recovery mode 86, allowing for relatively stable and continuous control of the refrigeration system for heat recovery loads ranging from zero to full heat recovery and across a range of ambient temperatures.

Figure 6:
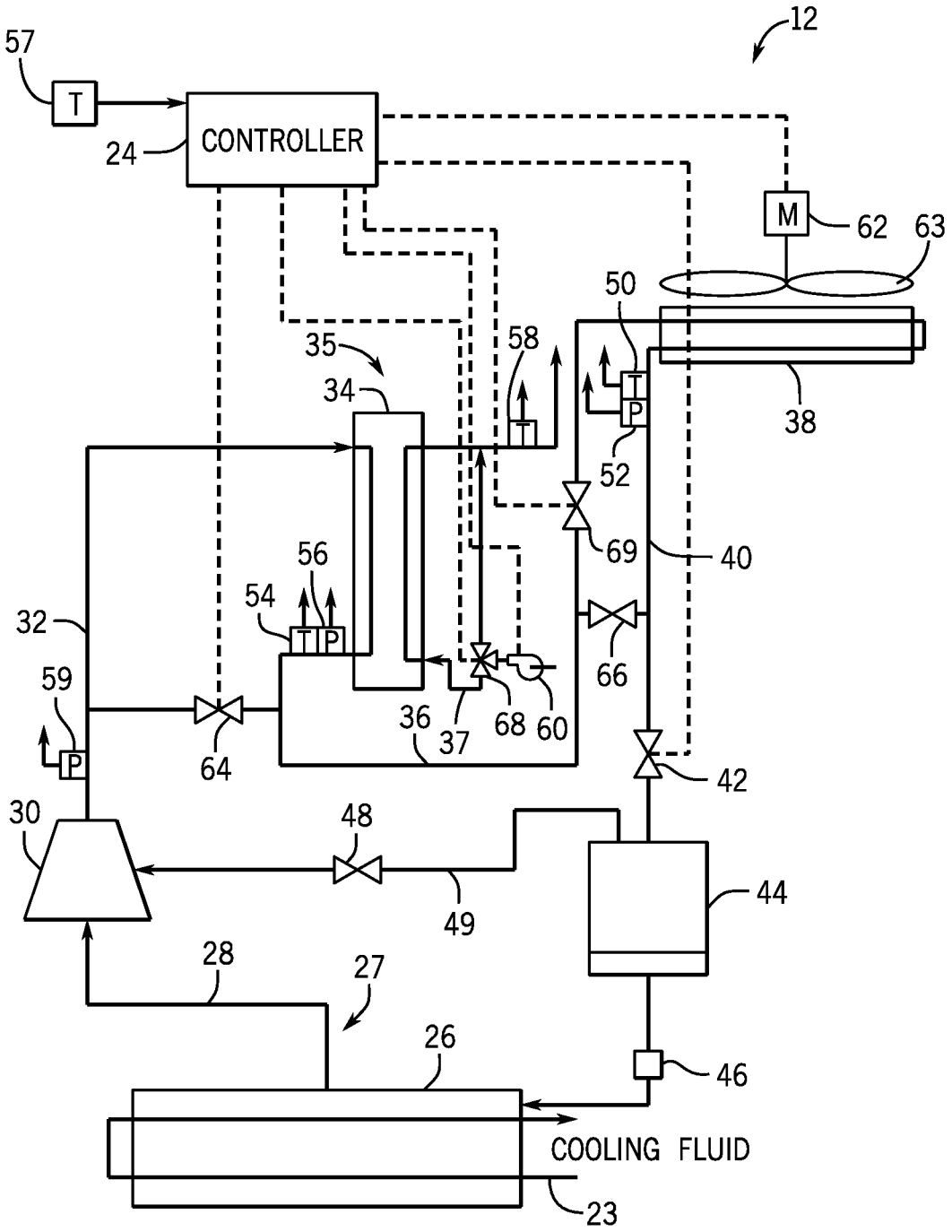
FIG. 6 is a diagrammatical representation of an exemplary HVAC&R system in accordance with the present techniques.

FIG. 6 illustrates another exemplary refrigeration system in accordance with aspects of the present technique. This system includes similar components as the refrigeration system of FIG. 2, but with a different configuration of the three-way heat recovery valve 68. In this configuration, the three-way valve 68 may provide additional control of the hot water temperature output by the HRHX 34, based on the measurements received from temperature sensor 58, without altering condenser fan speed or expansion valve position. The three-way valve 68 may be opened so that a relatively cooler supply water is mixed with heated water exiting the HRHX 34 when the demand for heat recovery is relatively low, and the three-way valve 68 may be closed such that all supply water is pumped through the HRHX 34 to facilitate relatively higher heat recovery. In this way, the controller 24 may position the three-way heat recovery valve 68 to provide a fine adjustment of the heat recovery output temperature as the system operates in any control mode 70. It should be noted that other arrangements and configurations of the refrigeration system may be employed, with or without certain components, e.g., optional bypass valves and the like. Additional sensors may also be used or incorporated in different configurations to provide measurements of fluid temperature within fluid lines or pressure drops across refrigeration components. Such measurements may be received by the controller 24 for monitoring and controlling operation of the refrigeration system for any desired amount of heat recovery.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A refrigeration system comprising:

an evaporator configured to cool a cooling fluid via heat exchange with a refrigerant;

a compressor configured to receive the refrigerant from the evaporator and compress the refrigerant;

a heat recovery heat exchanger configured to receive the compressed refrigerant and transfer heat from the compressed refrigerant to a process fluid;

a condenser configured to receive and to condense the compressed refrigerant from the heat recovery heat exchanger;

an expansion valve configured to expand the condensed refrigerant; and a controller configured to:

compare a temperature of the process fluid exiting the heat recovery heat exchanger to a setpoint temperature, wherein the controller is configured to determine a heat recovery demand when a difference between the temperature and the setpoint temperature exceeds a threshold;

operate the refrigeration system in a heat recovery mode of a plurality of heat recovery modes in response to determining the heat recovery demand, wherein the controller is configured to determine the heat recovery mode based on a heat recovery load, wherein the heat recovery load is determined by comparing a determined amount of heat transferred from the refrigerant to the process fluid through the heat recovery heat exchanger with an amount of heat available from the refrigerant flowing through the refrigeration system; and increase a flow of the process fluid through the heat recovery heat exchanger, decrease a fan speed of the condenser, and control the expansion valve in response to determining an increase in the heat recovery load.

2. The refrigeration system of claim 1, wherein the controller is configured to determine the heat recovery load by calculating the amount of heat transferred from the refrigerant to the process fluid as a percentage of a value for an amount of heat transferred from the cooling fluid to the refrigerant in the evaporator added to an amount of power input to the compressor.

3. The refrigeration system of claim 2, comprising a temperature sensor configured to measure the temperature of the process fluid exiting the heat recovery heat exchanger.

4. The refrigeration system of claim 2, wherein the controller is configured to operate in a low heat recovery mode of the plurality of heat recovery modes by controlling the fan speed at a speed appropriate for normal chiller operation, controlling the expansion valve to maintain a level of subcooling of the refrigerant exiting the condenser, and maintaining a bypass valve to control flow of the process fluid through the heat recovery heat exchanger.

5. The refrigeration system of claim 2, wherein the controller is configured to operate in an intermediate heat recovery mode of the plurality of heat recovery modes by controlling the fan speed based on a lower of a speed calculated based on normal chiller operation and a speed calculated based on a temperature at a process fluid exit of the heat recovery heat exchanger, controlling the expansion valve based on a larger of a value calculated based on refrigerant leaving the condenser and refrigerant leaving the heat recovery heat exchanger, and controlling a bypass valve to initially open to allow full flow of the process fluid through the heat recovery heat exchanger.

6. The refrigeration system of claim 2, wherein the controller is configured to operate in a full heat recovery mode of the plurality of heat recovery modes by controlling the fan speed at a speed calculated based on a temperature at a process fluid exit of the heat recovery heat exchanger, controlling the expansion valve to maintain a level of subcooling of the refrigerant exiting the heat recovery heat exchanger, and controlling a bypass valve to initially open to allow full flow of the process fluid through the heat recovery heat exchanger.

7. The refrigeration system of claim 2, wherein the controller is configured to operate in a low heat recovery mode of the plurality of heat recovery modes when the calculated amount of heat transferred from the refrigerant to the process fluid as a percentage of a value for an amount of heat transferred from the cooling fluid to the refrigerant in the evaporator added to an amount of power input to the compressor is approximately between 0 and 50 percent.

8. The refrigeration system of claim 2, wherein the controller is configured to operate in an intermediate heat recovery mode of the plurality of heat recovery modes when the calculated amount of heat transferred from the refrigerant to the process fluid as a percentage of a value for an amount of heat transferred from the cooling fluid to the refrigerant in the evaporator added to an amount of power input to the compressor is approximately between 50 and 80 percent.

9. The refrigeration system of claim 2, wherein the controller is configured to operate in a full heat recovery mode of the plurality of heat recovery modes when the calculated amount of heat transferred from the refrigerant to the process fluid as a percentage of a value for an amount of heat transferred from the cooling fluid to the refrigerant in the evaporator added to an amount of power input to the compressor is approximately between 80 and 100 percent.

10. A refrigeration system, comprising:

a compressor configured to compress a refrigerant;

a heat recovery heat exchanger configured to receive the compressed refrigerant and transfer heat from the compressed refrigerant to a process fluid;

a condenser configured to receive and to condense the compressed refrigerant;

an expansion valve configured to expand the condensed refrigerant;

an economizer configured to receive the expanded refrigerant and to at least partially vaporize the refrigerant;

an evaporator configured to receive refrigerant from the economizer and to vaporize the refrigerant;

a temperature sensor configured to sense a temperature of the process fluid exiting the heat recovery heat exchanger; and a controller coupled to the temperature sensor and configured to:

compare the sensed temperature of the process fluid exiting the heat recovery heat exchanger to a setpoint temperature and, in response to a difference between the sensed temperature and the setpoint temperature exceeding a threshold, determine a heat recovery demand;

operate in a heat recovery mode of a plurality of heat recovery modes in response to determining the heat recovery demand, wherein the controller is configured to determine the heat recovery mode based at least in part on a heat recovery load, wherein the heat recovery load is determined by comparing a determined amount of heat transferred from the refrigerant to the process fluid through the heat recovery heat exchanger with an amount of heat transferred from a cooling fluid to the refrigerant in the evaporator; and increase a flow of the process fluid through the heat recovery heat exchanger, decrease a fan speed of the condenser, and control the expansion valve in response to determining an increase in the heat recovery load.

11. The refrigeration system of claim 10, wherein the controller is configured to operate in the heat recovery mode of the plurality of heat recovery modes based at least in part on calculating an amount of heat transferred from the refrigerant to the process fluid through the heat recovery heat exchanger as a percentage of a value for an amount of heat transferred from the cooling fluid to the refrigerant in the evaporator added to an amount of power input to the compressor.

12. The refrigeration system of claim 11, wherein the controller is configured to operate in a low heat recovery mode of the plurality of heat recovery modes when the calculated percentage is between 0 and a first threshold percentage greater than 0 percent, operate in an intermediate heat recovery mode of the plurality of heat recovery modes when the calculated percentage is between the first threshold percentage and a second threshold percentage greater than the first threshold percentage and less than 100 percent, and operate in a full heat recovery mode of the plurality of heat recovery modes when the calculated percentage is above the second threshold percentage.

13. The refrigeration system of claim 10, wherein the economizer comprises:

a flash tank configured to at least partially vaporize the refrigerant; or a heat exchanger configured to cool a first stream of the refrigerant by vaporizing a second stream of the refrigerant.

14. The refrigeration system of claim 10, wherein the evaporator comprises:

a shell and tube evaporator, wherein the refrigerant flows through a shell side of the evaporator;

a shell and tube evaporator, wherein the refrigerant flows through a tube side of the evaporator; or a plate heat exchanger, wherein the refrigerant flows in channels formed by plates.

15. A method, comprising:

determining if there is a demand for heat recovery through a heat recovery heat exchanger in a refrigeration system based on a set point temperature and a measured temperature of a process fluid exiting the heat recovery heat exchanger;

determining a heat recovery load in response to determining that there is the demand for heat recovery, wherein the heat recovery load is determined by comparing a determined amount of heat transferred from the refrigerant to the process fluid through the heat recovery heat exchanger with an amount of heat available from the refrigerant flowing through the refrigeration system; and increasing a flow of the process fluid through the heat recovery heat exchanger, decreasing a fan speed of a condenser of the refrigeration system, and controlling an expansion valve of the refrigeration system in response to determining an increase in the heat recovery load.

16. The method of claim 15, comprising:

controlling the refrigeration system based on a low heat recovery mode when the determined heat recovery load is a low heat recovery load;

controlling the refrigeration system based on an intermediate heat recovery mode when the determined heat recovery load is an intermediate heat recovery load; and controlling the refrigeration system based on a full heat recovery mode when the determined heat recovery load is neither the low heat recovery mode nor the intermediate heat recovery load.

17. The method of claim 16, wherein controlling the refrigeration system based on the low heat recovery mode comprises:

controlling the fan speed at a speed appropriate for normal chiller operation;

controlling the expansion valve to maintain a level of subcooling of the refrigerant exiting the condenser; and maintaining a bypass valve to control flow of the process fluid through the heat recovery heat exchanger.

18. The method of claim 16, wherein controlling the refrigeration system based on the intermediate heat recovery mode comprises:

calculating a first fan speed of the condenser based on normal chiller operation;

calculating a second fan speed of the condenser based on a temperature at a process fluid exit of the heat recovery heat exchanger;

driving a fan motor of the condenser at a minimum of the first and second fan speeds;

calculating a first valve opening of the expansion valve based on an amount of subcooling of refrigerant leaving the condenser;

calculating a second valve opening of the expansion valve based on an amount of subcooling of refrigerant leaving the heat recovery heat exchanger; and opening the expansion valve to a maximum opening of the first and second valve openings.

19. The method of claim 16, wherein controlling the refrigeration system based on the full heat recovery mode comprises:

controlling the fan speed at a speed calculated based on a temperature at a process fluid exit of the heat recovery heat exchanger;

controlling the expansion valve to maintain a level of subcooling of the refrigerant exiting the heat recovery heat exchanger; and maintaining a bypass valve to initially open to allow full flow of the process fluid through the heat recovery heat exchanger.

20. The method of claim 15, wherein determining the heat recovery load comprises calculating the amount of heat transferred from the refrigerant to the process fluid as a percentage of a value for an amount of heat transferred from a cooling fluid to the refrigerant in an evaporator of the refrigeration system added to an amount of power input to a compressor of the refrigeration system.

21. The method of claim 20, comprising:

determining a low heat recovery load when the calculated percentage is between 0 and a first threshold percentage greater than 0 percent; and determining an intermediate heat recovery load when the calculated percentage is between the first threshold percentage and a second threshold percentage less than 100 percent.

22. The refrigeration system of claim 1, wherein the controller is configured to decrease the flow of the process fluid through the heat recovery heat exchanger, increase the fan speed of the condenser, and control the expansion valve in response to determining a decrease in the heat recovery load.

* * * * *